US010096413B2

(12) United States Patent
Nagata

(10) Patent No.: US 10,096,413 B2
(45) Date of Patent: Oct. 9, 2018

(54) QUENCHED ALLOY FOR RARE EARTH MAGNET AND A MANUFACTURING METHOD OF RARE EARTH MAGNET

(71) Applicant: XIAMEN TUNGSTEN CO., LTD., Fujian (CN)

(72) Inventor: Hiroshi Nagata, Fujian (CN)

(73) Assignee: XIAMEN TUNGSTEN CO., LTD., Fujian (CN)

( * ) Notice: Subject to any disclaimer, the term of this patent is extended or adjusted under 35 U.S.C. 154(b) by 53 days.

(21) Appl. No.: 15/328,258

(22) PCT Filed: Jul. 30, 2015

(86) PCT No.: PCT/CN2015/085555

§ 371 (c)(1),
(2) Date: Jan. 23, 2017

(87) PCT Pub. No.: WO2016/015662

PCT Pub. Date: Feb. 4, 2016

(65) Prior Publication Data

US 2018/0096763 A1 Apr. 5, 2018

(30) Foreign Application Priority Data

Jul. 30, 2014 (CN) ..... 2014 1 0369180

(51) Int. Cl.

| | |
|---|---|
| ***H01F 1/057*** | (2006.01) |
| ***C22C 38/00*** | (2006.01) |
| ***C22C 38/06*** | (2006.01) |
| ***C22C 38/16*** | (2006.01) |

(52) U.S. Cl.

CPC ..... *H01F 1/0577* (2013.01); *C22C 38/005* (2013.01); *C22C 38/06* (2013.01); *C22C 38/16* (2013.01); *H01F 1/0571* (2013.01); *C22C 2202/02* (2013.01)

(58) Field of Classification Search

CPC ..... H01F 1/0577

See application file for complete search history.

(56) References Cited

U.S. PATENT DOCUMENTS

| | | | | |
|---|---|---|---|---|
| 5,223,047 | A | 6/1993 | Endock et al. | |
| 5,431,747 | A * | 7/1995 | Takebuchi | C22C 33/02 148/302 |
| 2005/0098253 | A1 | 5/2005 | Doujak | |
| 2009/0072938 | A1 | 3/2009 | Nakajima et al. | |
| 2009/0035170 | A1 | 5/2009 | Nakajima et al. | |

FOREIGN PATENT DOCUMENTS

| | | | |
|---|---|---|---|
| CN | 1166677 | A | 12/1997 |
| CN | 1335628 | A | 2/2002 |
| CN | 1409332 | A | 4/2003 |
| CN | 102956337 | A | 3/2013 |
| CN | 103842112 | A | 6/2014 |
| EP | 2302646 | A1 | 3/2011 |
| EP | 2740551 | A1 | 6/2014 |
| JP | 07-045412 | A | 2/1995 |
| JP | 2000303153 | A | 10/2000 |
| JP | 2002059245 | A | 2/2002 |
| JP | 2002064010 | A | 2/2002 |
| JP | 2008214747 | A | 9/2008 |
| JP | 2008231535 | A | 10/2008 |
| JP | 2013070062 | A | 4/2013 |
| JP | 2013236071 | A | 11/2013 |
| JP | 2014132628 | A | 7/2014 |
| WO | 2009004994 | A1 | 1/2009 |
| WO | 2013122256 | A1 | 5/2015 |

OTHER PUBLICATIONS

International Search Report in international application No. PCT/CN2015/085555, dated Nov. 11, 2015, 4 pgs.

Written Opinion in international application No. PCT/CN2015/085555, dated Nov. 11, 2015, 9 pgs.

EP Search Report cited in EP Application No. 15 826 755.9 dated Nov. 27, 2017, 8 pgs.

Japanese Office Action cited in Japanese Application No. 2017-505079 dated Mar. 15, 2018, 9 pgs.

* cited by examiner

*Primary Examiner* — Jessee R Roe

(74) *Attorney, Agent, or Firm* — Cooper Legal Group, LLC

(57) ABSTRACT

The present invention is provided with a quenched alloy for rare earth magnet and a manufacturing method of rare earth magnet. It comprises an $R_2T_{14}B$ main phase, wherein R is selected from at least one rare earth element including Nd. The average grain diameter of the main phase in the brachyaxis direction is in a range of 10~15 μm and the average interval of the Nd rich phase is in a range of 1.0~3.5 μm. In the fine powder of the above-mentioned quenched alloy, the number of magnet domains of a single grain decreases. Thus, it is easier for external magnetic field orientation to obtain high performance magnet, and the squareness, coercivity and the thermal resistance of the magnet are sufficiently improved.

6 Claims, 1 Drawing Sheet

QUENCHED ALLOY FOR RARE EARTH MAGNET AND A MANUFACTURING METHOD OF RARE EARTH MAGNET

FIELD OF THE INVENTION

The present invention relates to a magnet manufacturing field, especially to a quenched alloy for rare earth magnet and a manufacturing method of rare earth magnet.

BACKGROUND OF THE INVENTION

For high performance magnets with more than 40MGOe of (BH)max used in various high performance electrical machines and electric generators, it is very necessary to develop high magnetization magnets. That is, magnets with low B composition to reduce the usage amount of the non-magnetic element B.

Recently, the development of low B composition magnets has been attempted through various methods, but no marketable product has been developed yet. The biggest drawback of the low B composition magnets is the poor squareness (Hk or SQ) of the demagnetization curve, which leads to poor magnetizing performance of the magnets. The reason is complicated, but it is mainly due to the existence of $R_2Fe_{17}$ phase and the lack of rich B phase ($R_1T_4B_4$ phase), which results in partial shortage of B in the grain boundary.

A low B rare earth magnet is disclosed in JPO with publishing number 2013-70062. It comprises R (R is at least one element comprising Y, Nd is the necessary component), B, Al, Cu, Zr, Co, O, C and Fe, wherein: R: 35~24 wt %, B: 0.87~0.94 wt %, Al: 0.03~0.3 wt %, Cu: 0.03~0.11 wt %, Zr: 0.03~0.25 wt %, Co: below 3 wt % (excluding 0%), O: 0.03~0.1 wt %, C: 0.03~0.15 wt % and the rest is Fe. This document reduces the content of rich B phase by reducing the content of B so as to increase the volume of main phase, finally obtaining a magnet with high Br. Commonly, if the content of B is reduced, it would form a soft magnetic $R_2T_{17}$ phase (usually $R_2Fe_{17}$ phase), which leads to a decrease of coercivity (Hcj). The present invention restrains the separation of the $R_2T_{17}$ phase by adding a small amount of Cu, causing a $R_2T_{14}C$ phase with increased Hcj and Br. However, there are still problems with the above-mentioned low B high Cu magnet or low B high Cu with a medium Al magnet such as low SQ, which leads to a high minimum saturation magnetization field and makes it difficult to magnetize. The easy magnetization strength of the magnet can be represented by the minimum saturation magnetic field. Generally, when the magnetic field strength increases 50% from a value, if the increment of (BH)max or Hcb of the samples does not exceed 1%, the magnetic field value is the minimum saturation magnetic field. For convenient presentation, it usually takes a magnetization curve in open-circuit state in a magnet with the same size to describe the easy magnetization strength of the magnet. The shape of the magnetization curve is influenced by the magnet composition and the microscopic structure. In open-circuit state, the magnetization process of the magnet relates to the shape and the size. For a magnet with the same shape and size, the smaller the lowest saturation magnetic field is, the more easily the magnet magnetizes.

On the other hand, to achieve convenient assembly and reduce impurity absorbent and the management cost, some high class products are applied with re-magnetization after assembly method. In open-circuit state, high performance NdFeB magnets need a magnetic field above 2.0 T for saturation magnetization. Especially for magnets with a smaller draw ratio (the ratio of the length of the magnet in the orientation direction to the largest diameter of the magnet vertical to the magnetization direction), a larger magnetic field is needed in open-circuit state for saturation magnetization. However, as the field of the magnetization device is limited by the cost and the space, it usually cannot achieve saturation magnetization for high performance sintered NdFeB magnets. Therefore, to achieve large enough magnetic flow, it usually needs magnet with higher magnetic energy product. For example, it could have used magnets with 35MGOe of magnetic energy product, but it has to use magnets with more than 38MGOe of magnetic energy product, which increases the cost. Therefore, how to improve the SQ and magnetization characteristic of Nd—Fe—B magnet to make the magnet achieve saturation magnetization more easily are recent technical problems. The development of magnets with high SQ and high magnetization performance becomes very important.

SUMMARY OF THE INVENTION

The object of the present invention is to overcome the disadvantages of the existing known technology and provide a quenched alloy for rare earth magnet. The number of magnetic domains in a single grain decreases in the fine powder of the quenched alloy, which is easier for the external magnetic field orientation to obtain a high performance magnet that can be magnetized easily.

The technical proposal of the present invention is a quenched alloy for rare earth magnet, comprising a $R_2Fe_{14}B$ main phase, wherein R is selected from at least one rare earth element including Nd, and wherein the average grain diameter of the main phase in the brachyaxis direction is 10~15 μm and the average interval of the Nd rich phase is 1.0~3.5 μm.

As the grain diameter of the main phase of the alloy is decreased, different from the quenched alloy of the present invention, the average grain diameter of the main phase of a normal quenched alloy in the brachyaxis direction is 20~30 μm and the average interval of the Nd rich phase is 4~10 μm. Therefore, fine alloy powder can be obtained after the hydrogen decrepitation process and the jet milling process. In the fine powder of the above-mentioned quenched alloy, the number of magnetic domains in a single grain decrease, which is easier for the external magnetic field orientation to obtain high performance magnet that can be magnetized easily. In addition, the squareness, the coercivity and the heat resistance of the magnet are obviously improved.

The rare earth element of the present invention comprises yttrium.

Generally speaking, a plurality of thin layers of Nd rich phase are at the center of a crystal grain. A very common wrong view in literature is that the grain diameter of the main phase is determined by the internal of the thin layer of Nd rich phase. However, in the present invention, the correct method is applied to determine the grain diameter of the main phase. In the present invention, the grain diameter of the main phase is defined at the approximate center position of the thickness direction of the quenched alloy sheet. The average value of the grain diameter of $Nd_2Fe_{14}B$ is determined by the gradation in the brachyaxis direction using the Kerr imaging method.

In another preferred embodiment, the rare earth magnet is an Nd—Fe—B magnet.

In another preferred embodiment, the average thickness of the quenched alloy is in a range of 0.2~0.4 mm.

In another preferred embodiment, counted in weight percent, more than 95% of the quenched alloy has the thickness in a range of 0.1~0.7 mm.

The present invention improves the microstructure of the grain by controlling the thickness of the quenched alloy. In detail, the quenched alloy with sheet thickness thinner than 0.1 mm comprises more amorphous phase and isometric grains, which leads to the main phase with smaller grain diameter, the average internal of two adjacent Nd phase gets shorter, the resistance to the nucleation and growth of the magnetic domain in the grain during orientation increases, and the magnetization performance gets worse. In contract, the quenched alloy with sheet thickness thicker than 0.7 mm comprises more α-Fe and $R_2Fe_{17}$ phase, which forms a larger Nd rich phase, leading to the average internal of two adjacent Nd phase getting shorter, the resistance to the nucleation and growth of the magnetic domain in the grain during orientation increasing, the magnetization performance getting worse.

In another preferred embodiment, the alloy for rare earth magnet is obtained by strip casting a molten alloy fluid of raw material and being cooled at a cooling rate between $10^{2\circ}$ C./s and $10^{4\circ}$ C./s. The raw material of the quenched alloy comprises: R: 13.5 at %~15.5 at %, B: 5.2 at %~5.8 at %, Cu: 0.1 at %~0.8 at %, Al: 0.1 at %~2.0 at %, W: 0.0005 at %~0.03 at %, T: 0 at %~2.0 at %, where T is selected from at least one of the elements Ti, Zr, V, Mo, Co, Zn, Ga, Nb, Sn, Sb, Hf, Bi, Ni, Si, Cr, Mn, S and P, and the rest components comprise Fe and unavoidable impurity.

In the present invention, it controls that Cu in a range of 0.1 at %~0.8 at %, Al in a range of 0.1 at %~2.0 at %, B in a range of 5.2 at %~5.8 at %, W in a range of 0.0005 at %~0.03 at %, so that the Cu does not enter the $Nd_2Fe_{14}B$ main phase, mainly distributes in the Nd rich phase, W separates out of the $R_2Fe_{14}B$ and concentrates to the grain boundary and then separates out in tiny and uniform way, so that the main phase grain gets smaller, and part of Al occupies the 8j2 crystal site of the main phase and forms —Fe layer with the adjacent Fe in the main phase to control the grain diameter of the main phase. The addition of Al makes the alloy powder get fine and, at the same time, the lumpiness of Nd rich phase and Rich B phase get smaller, and part of Al enters the Nd rich phase to act with the Cu, so that the contact angle of the Nd rich phase and the main phase is improved, making the Nd rich phase very uniformly arranged at the boundary. Under the common action of Cu, Al, W, the low B magnet has average grain diameter of main phase in a range of 10~15 μm and the average internal of Nd rich phase in a range of 1.0~3.5 μm. Therefore, in the fine powder made of above mentioned alloy, the resistance to the nucleation and growth of the magnet domain of the grain during orientation decreases and the domain boundary moves fast, so that all the magnetic domains rotates to the same direction of the magnetic field and saturation magnetization is achieved.

The unavoidable impurity comprises at least one element selected from O, C and N.

In the present invention, W can be an impurity that came from the raw material (pure Fe, rare earth metal, B, etc.). The raw material of the present invention is determined according to the amount of the impurity of the raw material. The raw material (pure Fe, rare earth metal, B, etc.) of the present invention can be selected such that the amount of W is below the threshold of the existing device. Though W can be regarded as not contained with the amount of the W metal raw material, it still be applied with the method of the present invention In a word, the raw material comprises a necessary amount of W, no matter where W comes from. Table 1 provides examples of the content of the W element of metal Nd in different producing areas and different workshops.

TABLE 1

Content of the W element in metal Nd from different producing areas and different workshops

| Raw material of metal Nd | purity | W concentration (ppm) |
|---|---|---|
| A | 2N5 | Less than the testing limit |
| B | 2N5 | 1 |
| C | 2N5 | 11 |
| D | 2N5 | 28 |
| E | 2N5 | 89 |
| F | 2N5 | 150 |
| G | 2N5 | 251 |

In TABLE 1, 2N5 means 99.5%.

It should be noted that, in recent mostly used rare earth manufacturing methods, there is a method to apply with graphite crucible electrolytic bath, the cylindrical graphite crucible is served as the positive pole, wolfram (W) rod disposed at the axis of the crucible is severed as the negative pole, and the bottom portion is applied with wolfram crucible to collect the rare earth metal. In the process of manufacturing a rare earth element (such as Nd), a small amount of W is unavoidable. In other cases, it can apply with molybdenum (Mo) or other metal with high melting point served as the negative pole, and the molybdenum crucible used to collect the rare earth metal so as to obtain rare earth element without W.

In the preferred embodiment, the content of Cu is preferably in a range of 0.3 at %~0.7 at %. When the content of Cu is 0.3 at %~0.7 at %, the squareness exceeds 99% so that it can manufacture magnets with good heat resistance performance and good magnetization performance. When the content of Cu is beyond 0.3 at %~0.7 at %, the squareness decreases. Once the squareness gets worse, the irreversible flux loss of the magnet gets worse and the heat resistance performance gets worse as well.

In another preferred embodiment, the alloy for rare earth magnet is kept in a material container for 0.5~5 hours in a preservation temperature of 500~700° C. after being cooled to 500μ750° C. After the heat preservation process, the elongated Nd rich phase of the main phase crystal shortens towards the central area, the Nd rich phase changes to compact and concentrate, and the average interval of the Nd rich phase is controlled preferably.

It should be noted that, in the present invention, the content of R in a range of 13.5 at %~15.5 at % is a common selection in this field. Therefore, it does not further test and prove the content of R in the embodiments.

The other object of the present invention is to provide a manufacturing method of rare earth magnet.

The manufacturing method of a rare earth magnet comprises the processes:

1) coarsely crushing an quenched alloy for rare earth magnet according to any of claims 1~6 and finely crushing the power to fine powder;
2) placing the fine powder under a magnetic field for pre-orientating and obtaining green compacts under a magnetic field;
3) sintering the green compacts in vacuum or in inert gas atmosphere in a temperature of 900° C.~1100° C.

Compared to the existing known technology, the present invention has advantages as follows:

1) The average grain diameter of the main phase of the quenched alloy for rare earth magnet in the present invention in the brachyaxis direction is 10~15 μm and the average interval of the Nd rich phase is 1.0~3.5 μm. Therefore, in the fine powder of the above mentioned quenched alloy, the number of magnetic domain of single grain decreases so that it is easier for external magnetic field orientation to obtain magnetization high performance magnet.
2) Because the influence the residual magnetization of the magnet does not matter, in the fine powder made of above mentioned alloy, the resistance to the nucleation and growth of the magnet domain of the grain during orientation decreases and the domain boundary moves fast, so that all the magnetic domains rotates to the same direction of the magnetic field and achieves saturation magnetization.
3) The present invention makes Al arranged properly in the main phase and the grain boundary by controlling the content of the Al. Therefore, part of Al enters the internal portion of the main phase to control the grain diameter of the main phase crystal, another part of Al and Cu work together to improve the contact angle between the Nd rich phase and the main phase, making the Nd rich phase arranged uniformly along the boundary, such that the average grain diameter of the main phase in the brachyaxis direction is 10~15 μm and the average interval of the Nd rich phase is 1.0~3.5 μm.
4) The present invention controls the thickness of more than 95% of the quenched alloy in a range of 0.1~0.7 mm. It improves the microstructure of the grain by controlling the thickness of the quenched alloy, making the average grain diameter of the main phase crystal and the arrangement of Nd rich phase more uniform.
5) W is added to the raw material. W separates out in tiny and uniform way, so that W can be used to control the grain diameter of the main phase crystal of the alloy and the main phase grain gets smaller.

DETAILED DESCRIPTION OF THE EMBODIMENTS

Figure 1:
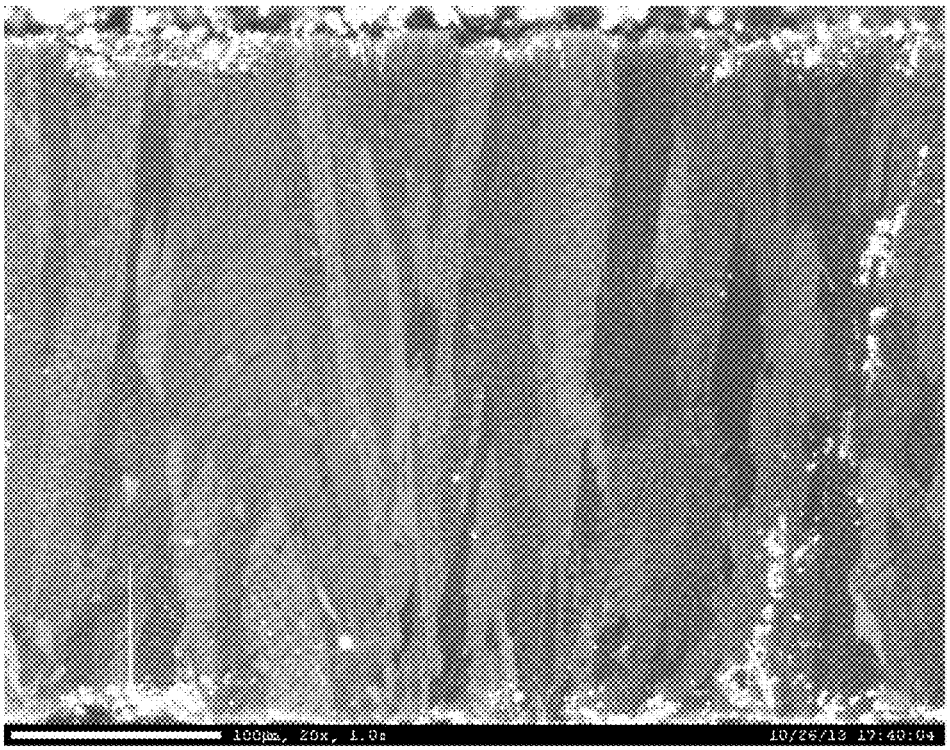
FIG. 1 illustrates a schematic diagram of the main phase crystal of Embodiment 2 of SC sheet magnified 1000 times under the Kerr metallographic microscopes in the first embodiment.

The present invention will be further described with the embodiments.

The First Embodiment

Raw material preparation process: Nd with 99.5% purity, Dy with 99.8% purity, industrial Fe—B, industrial pure Fe, Cu and Al with 99.5% purity and W with 99.999% purity are prepared, counted in atomic percent.

The contents of the elements are shown in TABLE 2.

TABLE 2

| | proportioning of each element (at %) | | | | | | |
|---|---|---|---|---|---|---|---|
| Number | Nd | Dy | B | Cu | Al | W | Fe |
| Comparing sample 1 | 13.8 | 1.0 | 5.2 | 0.05 | 0.4 | 0.01 | rest |
| Embodiment 1 | 13.8 | 1.0 | 5.2 | 0.1 | 0.4 | 0.01 | rest |
| Embodiment 2 | 13.8 | 1.0 | 5.2 | 0.3 | 0.4 | 0.01 | rest |
| Embodiment 3 | 13.8 | 1.0 | 5.2 | 0.5 | 0.4 | 0.01 | rest |
| Embodiment 4 | 13.8 | 1.0 | 5.2 | 0.6 | 0.4 | 0.01 | rest |
| Embodiment 5 | 13.8 | 1.0 | 5.2 | 0.7 | 0.4 | 0.01 | rest |
| Embodiment 6 | 13.8 | 1.0 | 5.2 | 0.8 | 0.4 | 0.01 | rest |
| Comparing sample 2 | 13.8 | 1.0 | 5.2 | 0.9 | 0.4 | 0.01 | rest |

Preparing 10 Kg of raw material respectively by weighing in accordance with each row of TABLE 2.

In the melting process: each of the raw materials is put into an aluminum oxide made crucible and an intermediate frequency vacuum induction melting furnace is used to melt the raw material in $10^{-2}$ Pa vacuum below 1500° C.

In the casting process: Ar gas is supplied to the melting furnace so that the Ar pressure would reach 50000 Pa after the process of vacuum melting, then a single roller for quenching method is applied to quench. The quenched alloy is obtained in a cooling rate of $10^{2}$° C./s~$10^{4}$° C./s. The average thickness of the quenched alloy is 0.3 mm. Above 95% of the quenched alloy has a thickness in a range of 0.1~0.7 mm. The quenched alloy is kept in a temperature of 500° C. for 5 hours and then cooled to room temperature.

In the hydrogen decrepitation process: at room temperature, the quenched alloy is put into a hydrogen decrepitation furnace. The furnace is then pumped to vacuum and then hydrogen of 99.5% purity is supplied into the container. The hydrogen pressure will reach 0.1 MPa. After two hours of standing, the container is heated and pumped for 2 hours at 500° C. and then the container gets cooled. The cooled coarse powder is then taken out.

In the fine crushing process: jet milling process is used to finely crush the coarse powder in an atmosphere with the content of oxidizing gas below 100 ppm and under a pressure of 0.4 MPa to obtain a fine powder with an average particle size of 3.4 μm. The oxidizing gas comprises oxygen or moisture.

Part of the fine powder (30 wt % of the fine powder) after fine crushing is screened to remove the powder with grain diameter below 1.0 μm. The screened fine powder is then mixed with the unscreened fine powder. In the mixture, the volume of powder with grain diameter below 1.0 μm is decreased to below 10% of the total volume of the powder.

Methyl caprylate is added to the fine powder after jet milling. The additive amount is 0.15% of the weight of the mixed powder. The mixture is comprehensively blended by a V-type mixer.

In the compacting process under a magnetic field: a transverse type magnetic field molder is used and the powder with methyl caprylate is compacted to form a cube with sides of 25 mm in an orientation filed of 1.8 T and under a compacting pressure of 0.2 ton/cm$^2$. Then, the once-forming cube is demagnetized in a 0.2 T magnetic field.

The once-forming compact (green compact) is sealed so as not to expose to air. The compact is secondary compacted by a secondary compact machine (isostatic pressing compacting machine) under a pressure of 1.4 ton/cm$^2$.

In the sintering process: the green compact is moved to the sinter furnace for sintering, in a vacuum of $10^{-3}$ Pa and respectively maintained for 1.5 hours in 200° C. and for 1.5 hours in 850° C., then sintering for 2 hours in 1080° C. After that, Ar gas is supplied into the sintering furnace so that the Ar pressure reaches 0.1 MPa and then it is cooled to room temperature.

In the thermal treatment process: the sintered magnet is heated for 1 hour in 600° C. in the atmosphere of high purity Ar gas, then cooled to room temperature and taken out.

In magnetic property evaluation process: the sintered magnet is tested by NIM-10000H type nondestructive testing system for BH large rare earth permanent magnet from National Institute of Metrology.

The minimum strength of the saturation magnetic field: when the magnetization voltage increases, the magnetic field strength increases 50% from a value. If the increment of (BH)max or Hcb of the samples is not exceed 1%, the magnetic field value is the minimum strength of the saturation magnetic field.

In the testing process of the average grain diameter of the main phase: the SC sheet (the quenched alloy sheet) is put under the Kerr metallographic microscope magnified 200 times by photography and the roller surface is parallel to the lower edge of the view field. When testing, a straight line of 445 μm at the center position of the view field is drawn and the number of main phase crystals going through the straight line is counted to determine the average grain diameter of the main phase crystal. The testing result is illustrated in FIG. 1.

Figure 2:
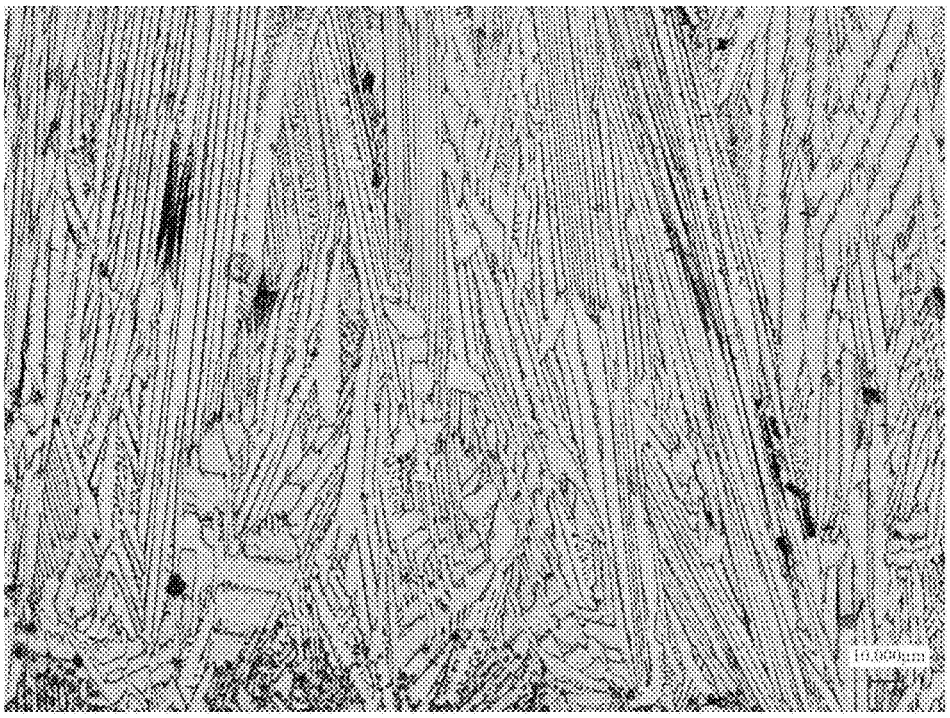
FIG. 2 illustrates a schematic diagram of the internal of Nd rich phase of Embodiment 2 of SC sheet magnified 1000 times under 3D color scanning laser microscopes in the first embodiment.

In the testing process of the Nd rich interval: the SC sheet is corroded by weak $FeCl_2$ solution ($FeCl_2$+HCl+alchol) and is then put under the 3D color scanning laser microscope magnified 1000 times by photography. The roller surface is parallel to the lower edge of the view field. When testing, a straight line of 283 μm at the center position of the view field is drawn and the number of secondary crystals going through the straight line is counted to determine the Nd rich interval. The testing result is illustrated in FIG. 2.

The evaluation of a magnetic property of the embodiments and the comparing samples are shown in TABLE 3.

TABLE 3 the magnetic property evaluation of the embodiments and the comparing samples

| Number | Average grain diameter of main phase crystal (brachyaxis, μm) | Average Nd rich phase interval (μm) | Br (kGs) | Hcj (kOe) | (BH) ma × (MGOe) | SQ (%) | minimum voltage of saturation magnetization (volt) |
|---|---|---|---|---|---|---|---|
| Comparing sample 1 | 25.22 | 3.80 | 13.4 | 13.5 | 41.7 | 87.5 | 2800 |
| Embodiment 1 | 14.88 | 2.42 | 13.8 | 15.2 | 45.7 | 96.8 | 2600 |
| Embodiment 2 | 13.81 | 2.11 | 13.9 | 15.4 | 46.3 | 99.5 | 2600 |
| Embodiment 3 | 13.26 | 1.82 | 14.1 | 15.4 | 48.2 | 99.7 | 2500 |
| Embodiment 4 | 12.96 | 1.57 | 14.0 | 15.4 | 46.9 | 99.6 | 2500 |
| Embodiment 5 | 11.99 | 1.26 | 14.0 | 15.9 | 46.8 | 99.6 | 2500 |
| Embodiment 6 | 10.62 | 1.15 | 13.9 | 15.5 | 46.4 | 97.2 | 2500 |
| Comparing sample 2 | 9.22 | 0.93 | 13.3 | 13.6 | 41.1 | 88.2 | 3000 |

In TABLE 3, the minimum voltage of saturation magnetization is the voltage value when the samples are saturated magnetized under the minimum strength of the magnetic field. In the present invention, magnetization is taken under the same magnetization device. Therefore, the magnetization voltage can represent the strength of the magnetic field.

As can be seen from TABLE 3, when the amount of Cu in the magnet is less than 0.1 at %, the distribution of Cu in the grain boundary of the Nd rich phase is insufficient. Therefore, it is difficult to form a composite phase with Al in the grain boundary, which leads to the average grain diameter of the main phase crystal increasing, the average interval of Nd rich phase enlarging, the resistance to the nucleation and growth of the magnetic domain during orientation in the grain increasing, residual magnetization and BH(max) decreasing, and the magnetic performance decreasing.

When the amount of Cu exceeds 0.8 at %, the amount of Cu in the grain is excessive, which leads to the average grain diameter of the main phase crystal decreasing, the average internal of Nd rich phase decreasing, the resistance to the nucleation and growth of the magnetic domain during orientation in the grain increasing, and the minimum strength of the saturation magnetic field increasing. It is not suited to use in a magnetic field in open-circuit state.

When the amount of Cu is in a range of 0.1 at %~0.8 at %, the squareness of the magnet exceeds 95% and it has good magnetization performance.

When the amount of Cu is in a range of 0.3 at %~0.7 at %, the squareness of the magnet exceeds 99%. The very good squareness can produce a magnet with good heat resistance performance.

The 5% heating demagnetize (heat resistance) temperature of the comparing samples 1 and 2 are 60° C. and 80° C., while the 5% heating demagnetize (heat resistance) temperature of the embodiments 1~6 are 110° C., 125° C., 125° C., 125° C., 125° C. and 120° C.

The Second Embodiment

In the raw material preparation process: Nd with 99.5% purity, Ho with 99.8% purity, industrial Fe—B, industrial pure Fe, Cu and Al with 99.5% purity and W with 99.999% purity are prepared, counted in atomic percent.

The contents of the elements are shown in TABLE 4.

TABLE 4 proportioning of each element (at %)

| No. | Nd | Ho | B | Cu | Al | W | Fe |
|---|---|---|---|---|---|---|---|
| Comparing sample 1 | 14 | 1.0 | 5.8 | 0.5 | 0.05 | 0.005 | rest |

TABLE 4-continued

| proportioning of each element (at %) | | | | | | | |
|---|---|---|---|---|---|---|---|
| No. | Nd | Ho | B | Cu | Al | W | Fe |
| Embodiment 1 | 14 | 1.0 | 5.8 | 0.5 | 0.1 | 0.005 | rest |
| Embodiment 2 | 14 | 1.0 | 5.8 | 0.5 | 0.5 | 0.005 | rest |
| Embodiment 3 | 14 | 1.0 | 5.8 | 0.5 | 0.8 | 0.005 | rest |
| Embodiment 4 | 14 | 1.0 | 5.8 | 0.5 | 1.2 | 0.005 | rest |
| Embodiment 5 | 14 | 1.0 | 5.8 | 0.5 | 1.6 | 0.005 | rest |
| Embodiment 6 | 14 | 1.0 | 5.8 | 0.5 | 2.0 | 0.005 | rest |
| Comparing sample 2 | 14 | 1.0 | 5.8 | 0.5 | 2.2 | 0.005 | rest |

Preparing 10 Kg of raw material respectively by weighing in accordance with each row of TABLE 4.

In the melting process: each of the raw materials is put into an aluminum oxide made crucible and an intermediate frequency vacuum induction melting furnace is used to melt the raw material in $10^{-2}$ Pa vacuum below 1500° C.

In the casting process: Ar gas is supplied to the melting furnace so that the Ar pressure would reach 50000 Pa after the process of vacuum melting, then a single roller for quenching method is applied to quench. The quenched alloy is obtained in a cooling rate of $10^{2}$° C./s~$10^{4}$° C./s. The average thickness of the quenched alloy is 0.25 mm. Above 95% of the quenched alloy has a thickness in a range of 0.1~0.7 mm. The quenched alloy is kept in a temperature of 700° C. for 0.5 hours and then cooled to room temperature.

In the hydrogen decrepitation process: at room temperature, the quenched alloy is put into a hydrogen decrepitation furnace. The furnace is then pumped to vacuum and then hydrogen of 99.5% purity is supplied into the container. The hydrogen pressure will reach 0.08 MPa. After two hours of standing, the container is heated and pumped for 1.5 hours at 480° C. and then the container gets cooled. The cooled coarse powder is then taken out.

In the fine crushing process: jet milling process is used to finely crush the coarse powder in an atmosphere with the content of oxidizing gas below 100 ppm and under a pressure of 0.45 MPa to obtain a fine powder with an average particle size of 3.4 μm. The oxidizing gas comprises oxygen or moisture.

Methyl caprylate is added to the fine powder after jet milling. The additive amount is 0.2% of the weight of the mixed powder. The mixture is comprehensively blended by a V-type mixer.

In the compacting process under a magnetic field: a transverse type magnetic field molder is used and the powder with methyl caprylate is compacted to form a cube with sides of 25 mm in an orientation filed of 1.8 T and under a compacting pressure of 0.2 ton/cm$^2$. Then, the once-forming cube is demagnetized in a 0.2 T magnetic field, the green compacts are taken out of the molder to another magnetic field, and the magnetic powder attached to the surface of the green compacts is secondary demagnetized.

The once-forming compact (green compact) is sealed so as not to expose to air. The compact is secondary compacted by a secondary compact machine (isostatic pressing compacting machine) under a pressure of 1.4 ton/cm$^2$.

In the sintering process: the green compact is moved to the sinter furnace for sintering, in a vacuum of $10^{-3}$ Pa and respectively maintained for 2 hours in 200° C. and for 2 hours in 900° C., then sintering for 2 hours in 1020° C. After that, Ar gas is supplied into the sintering furnace so that the Ar pressure reaches 0.1 MPa and then it is cooled to room temperature.

In the thermal treatment process: the sintered magnet is heated for 1 hour in 620° C. in the atmosphere of high purity Ar gas, then cooled to room temperature and taken out.

In magnetic property evaluation process: the sintered magnet is tested by NIM-10000H type nondestructive testing system for BH large rare earth permanent magnet from National Institute of Metrology.

The minimum strength of the saturation magnetic field: when the magnetization voltage increases, the magnetic field strength increases 50% from a value. If the increment of (BH)max or Hcb of the samples is not exceed 1%, the magnetic field value is the minimum strength of the saturation magnetic field.

In the testing process of the average grain diameter of the main phase: the SC sheet (the quenched alloy sheet) is put under the Kerr metallographic microscope magnified 200 times by photography and the roller surface is parallel to the lower edge of the view field. When testing, a straight line of 445 μm at the center position of the view field is drawn and the number of main phase crystals going through the straight line is counted to determine the average grain diameter of the main phase crystal. The testing result is illustrated in FIG. 1.

In the testing process of the Nd rich interval: the SC sheet is corroded by weak $FeCl_2$ solution ($FeCl_2$+HCl+alchol) and is then put under the 3D color scanning laser microscope magnified 1000 times by photography. The roller surface is parallel to the lower edge of the view field. When testing, a straight line of 283 μm at the center position of the view field is drawn and the number of secondary crystals going through the straight line is counted to determine the Nd rich interval. The testing result is illustrated in FIG. 2.

The evaluation of a magnetic property of the embodiments and the comparing samples are shown in TABLE 5.

TABLE 5

| the magnetic property evaluation of the embodiments and the comparing samples | | | | | | |
|---|---|---|---|---|---|---|
| Number | Average grain diameter of main phase crystal (brachyaxis, μm) | Average Nd rich phase interval (μm) | Br (kGs) | Hcj (kOe) | (BH) max (MGOe) | minimum voltage of saturation magnetization (volt) |
| Comparing sample 1 | 19.34 | 3.80 | 13.4 | 13.8 | 42.8 | 2800 |
| Embodiment 1 | 14.90 | 3.47 | 14.2 | 15.0 | 48.6 | 2600 |
| Embodiment 2 | 13.62 | 3.03 | 14.1 | 15.3 | 48.2 | 2600 |
| Embodiment 3 | 12.25 | 2.77 | 14.0 | 16.0 | 47.1 | 2500 |

TABLE 5-continued

| the magnetic property evaluation of the embodiments and the comparing samples | | | | | | |
|---|---|---|---|---|---|---|
| Number | Average grain diameter of main phase crystal (brachyaxis, μm) | Average Nd rich phase interval (μm) | Br (kGs) | Hcj (kOe) | (BH) max (MGOe) | minimum voltage of saturation magnetization (volt) |
| Embodiment 4 | 11.90 | 2.40 | 13.9 | 16.4 | 46.6 | 2500 |
| Embodiment 5 | 11.44 | 1.52 | 13.7 | 16.8 | 45.3 | 2500 |
| Embodiment 6 | 10.22 | 1.21 | 13.5 | 17.2 | 44.0 | 2600 |
| Comparing sample 2 | 9.29 | 0.92 | 13.4 | 13.8 | 42.2 | 2900 |

In TABLE 5, the minimum voltage of saturation magnetization is the voltage value when the samples are saturated magnetized under the minimum strength of the saturation magnetic field. In the present invention, magnetization is taken under the same magnetization device. Therefore, the magnetization voltage can represent the strength of the magnetic field.

SQ of Embodiments 1~6 reach to more than 99%, while SQ of the comparing samples 1~2 are less than 85%.

As can be seen from TABLE 5, when the amount of Al of the magnet is less than 0.1 at %, the distribution of Al in the grain boundary of the Nd rich phase and the main phase is insufficient. Therefore, it is difficult to form a composite phase with Cu in the grain boundary, which leads to that the average grain diameter of the main phase crystal increasing and the average interval of Nd rich phase enlarging, the resistance to the nucleation and growth of the magnetic domain during orientation in the grain increasing, residual magnetization and BH(max) decreasing, and the magnetic performance decreasing.

When the amount of Al exceeds 2.0 at %, the amount of Al in the grain is excessive, which leads to the average grain diameter of the main phase crystal decreasing, the average internal of Nd rich phase decreasing, the resistance to the nucleation and growth of the magnetic domain during orientation in the grain increasing, and the minimum strength of the saturation magnetic field to increasing. It is not suited to use in a magnetic field in open-circuit state.

The Third Embodiment

In the raw material preparation process: Nd with 99.5% purity, Ho with 99.5% purity, industrial Fe—B, industrial pure Fe, Al, Cu, Zr and Co with 99.5% purity and W with 99.999% purity are prepared, counted in atomic percent.

The contents of the elements are shown in TABLE 6.

TABLE 6

| proportioning of each element (at %) | | | | | | | | | |
|---|---|---|---|---|---|---|---|---|---|
| Number | Nd | Ho | B | Cu | Al | Co | Zr | W | Fe |
| Comparing sample 1 | 14 | 1.2 | 5.0 | 0.5 | 0.6 | 0.3 | 0.5 | 0.002 | rest |
| Comparing sample 2 | 14 | 1.2 | 5.1 | 0.5 | 0.6 | 0.3 | 0.5 | 0.002 | rest |
| Embodiment 1 | 14 | 1.2 | 5.2 | 0.5 | 0.6 | 0.3 | 0.5 | 0.002 | rest |
| Embodiment 2 | 14 | 1.2 | 5.3 | 0.5 | 0.6 | 0.3 | 0.5 | 0.002 | rest |
| Embodiment 3 | 14 | 1.2 | 5.4 | 0.5 | 0.6 | 0.3 | 0.5 | 0.002 | rest |
| Embodiment 4 | 14 | 1.2 | 5.5 | 0.5 | 0.6 | 0.3 | 0.5 | 0.002 | rest |
| Embodiment 5 | 14 | 1.2 | 5.6 | 0.5 | 0.6 | 0.3 | 0.5 | 0.002 | rest |

TABLE 6-continued

| proportioning of each element (at %) | | | | | | | | | |
|---|---|---|---|---|---|---|---|---|---|
| Number | Nd | Ho | B | Cu | Al | Co | Zr | W | Fe |
| Embodiment 6 | 14 | 1.2 | 5.7 | 0.5 | 0.6 | 0.3 | 0.5 | 0.002 | rest |
| Embodiment 7 | 14 | 1.2 | 5.8 | 0.5 | 0.6 | 0.3 | 0.5 | 0.002 | rest |
| Comparing sample 3 | 14 | 1.2 | 5.9 | 0.5 | 0.6 | 0.3 | 0.5 | 0.002 | rest |

Preparing 10 Kg of raw material respectively by weighing in accordance with each row of TABLE 6.

In the melting process: each of the raw materials is put into an aluminum oxide made crucible and an intermediate frequency vacuum induction melting furnace is used to melt the raw material in $10^{-2}$ Pa vacuum below 1500° C.

In the casting process: Ar gas is supplied to the melting furnace so that the Ar pressure would reach 60000 Pa after the process of vacuum melting, then a single roller for quenching method is applied to quench. The quenched alloy is obtained in a cooling rate of $10^{2}$° C./s~$10^{4}$° C./s. The average thickness of the quenched alloy is 0.38 mm. Above 95% of the quenched alloy has a thickness in a range of 0.1~0.7 mm. The quenched alloy is kept in a temperature of 600° C. for 3 hours and then cooled to room temperature.

In the hydrogen decrepitation process: at room temperature, the quenched alloy is put into a hydrogen decrepitation furnace. The furnace is then pumped to be vacuum and then hydrogen of 99.5% purity is supplied into the container. The hydrogen pressure will reach 0.09 MPa. After two hours of standing, the container is heated and pumped for 2 hours at 520° C. and then the container gets cooled. The cooled coarse powder is then taken out.

In the fine crushing process: jet milling process is used to finely crush the coarse powder in an atmosphere with the content of oxidizing gas below 100 ppm and under a pressure of 0.5 MPa to obtain a fine powder with an average particle size of 3.6 μm. The oxidizing gas comprises oxygen or moisture.

Methyl caprylate is added to the fine powder after jet milling. The additive amount is 0.2% of the weight of the mixed powder. The mixture is comprehensively blended by a V-type mixer.

In the compacting process under a magnetic field: a transverse type magnetic field molder is used, the powder with methyl caprylate is compacted to form a cube with sides of 25 mm in an orientation filed of 1.8 T and under a compacting pressure of 0.2 ton/$cm^2$. Then, the once-forming cube is demagnetized in a 0.2 T magnetic field, the green compacts are taken out of the molder to another magnetic field, and the magnetic powder attached to the surface of the green compacts is secondary demagnetized.

The once-forming compact (green compact) is sealed so as not to expose to air. The compact is secondary compacted by a secondary compact machine (isostatic pressing compacting machine) under a pressure of 1.4 ton/cm$^2$.

In the sintering process: the green compact is moved to the sinter furnace for sintering, in a vacuum of $10^{-3}$ Pa and respectively maintained for 2 hours in 200° C. and for 2 hours in 800° C., then sintering for 2 hours in 1030° C. After that, Ar gas is supplied into the sintering furnace so that the Ar pressure reaches 0.1 MPa and then it is cooled to room temperature.

In the thermal treatment process: the sintered magnet is heated for 1 hour in 580° C. in the atmosphere of high purity Ar gas, then cooled to room temperature and taken out.

In magnetic property evaluation process: the sintered magnet is tested by NIM-10000H type nondestructive testing system for BH large rare earth permanent magnet from National Institute of Metrology.

The minimum strength of the saturation magnetic field: when the magnetization voltage increases, the magnetic field strength increases 50% from a value. If the increment of (BH)max or Hcb of the samples is not exceed 1%, the magnetic field value is the minimum strength of the saturation magnetic field.

In the testing process of the average grain diameter of the main phase: the SC sheet (the quenched alloy sheet) is put under the Kerr metallographic microscope magnified 200 times by photography and the roller surface is parallel to the lower edge of the view field. When testing, a straight line of 445 μm at the center position of the view field is drawn and the number of main phase crystals going through the straight line is counted to determine the average grain diameter of the main phase crystal. The testing result is illustrated in FIG. 1.

In the testing process of the Nd rich interval: the SC sheet is corroded by weak $FeCl_2$ solution ($FeCl_2$+HCl+alchol) and is then put under the 3D color scanning laser microscope magnified 1000 times by photography. The roller surface is parallel to the lower edge of the view field. When testing, a straight line of 283 μm at the center position of the view field is drawn and the number of secondary crystals going through the straight line is counted to determine the Nd rich interval. The testing result is illustrated in FIG. 2.

The evaluation of a magnetic property of the embodiments and the comparing samples are shown in TABLE 7.

TABLE 7 the magnetic property evaluation of the embodiments and the comparing samples

| Number | Average grain diameter of main phase crystal (brachyaxis, μm) | Average Nd rich phase interval (μm) | Br (kGs) | Hcj (kOe) | (BH) ma × (MGOe) | minimum voltage of saturation magnetization (volt) |
|---|---|---|---|---|---|---|
| Comparing sample 1 | 20.56 | 3.96 | 12.8 | 14.5 | 38.1 | 3200 |
| Comparing sample 2 | 18.27 | 3.65 | 13.0 | 14.9 | 39.3 | 3100 |
| Embodiment 1 | 14.86 | 3.34 | 13.7 | 16.0 | 44.6 | 2500 |
| Embodiment 2 | 14.49 | 3.04 | 13.8 | 16.1 | 45.7 | 2500 |
| Embodiment 3 | 14.25 | 2.50 | 14.1 | 16.2 | 48.2 | 2500 |
| Embodiment 4 | 13.76 | 2.04 | 14.1 | 16.3 | 48.0 | 2500 |
| Embodiment 5 | 12.53 | 1.65 | 13.9 | 16.3 | 46.6 | 2500 |
| Embodiment 6 | 11.23 | 1.46 | 13.8 | 16.3 | 45.8 | 2500 |
| Embodiment 7 | 10.21 | 1.42 | 13.8 | 16.2 | 45.8 | 2500 |
| Comparing sample 3 | 9.20 | 1.36 | 13.2 | 14.8 | 40.1 | 2800 |

In TABLE 7, the minimum voltage of saturation magnetization is the voltage value when the samples are saturated magnetized under the minimum strength of the saturation magnetic field. In the present invention, magnetization is taken under the same magnetization device. Therefore, the magnetization voltage can represent the strength of the magnetic field.

SQ of Embodiments 1~7 reach to more than 99%, while SQ of the comparing samples 1~3 are less than 85%.

As can be seen from TABLE 7, when the amount of B of the magnet is less than 5.2 at %, the distribution of B in the grain boundary of the Nd rich phase and the main phase is insufficient. Therefore, the average grain diameter of the main phase crystal increases and the average interval of Nd rich phase enlarges, the resistance to the nucleation and growth of the magnetic domain during orientation in the grain increases, residual magnetization and BH(max) decrease, and the magnetic performance decreases.

When the amount of B of the magnet is less than 5.8 at %, residual magnetization and BH(max) decrease, it is difficult to obtain high performance magnet.

The Fourth Embodiment

In the raw material preparation process: Nd with 99.5% purity, industrial Fe—B, industrial pure Fe, Al, Cu, Zr and Co with 99.5% purity and W with 99.999% purity are prepared, counted in atomic percent.

To accurately control the proportion of W, in this embodiment, no W exists in Fd, Fe, B, Al, Cu, Zn and Co. All W comes from the W metal.

The contents of the elements are shown in TABLE 8.

TABLE 8 proportioning of each element (at %)

| Number | Nd | B | Cu | Al | Co | Zr | W | Fe |
|---|---|---|---|---|---|---|---|---|
| Comparing sample 1 | 14.5 | 5.5 | 0.4 | 0.5 | 0.3 | 0.3 | 0.0001 | rest |

TABLE 8-continued

| proportioning of each element (at %) | | | | | | | | |
|---|---|---|---|---|---|---|---|---|
| Number | Nd | B | Cu | Al | Co | Zr | W | Fe |
| Embodiment 1 | 14.5 | 5.5 | 0.4 | 0.5 | 0.3 | 0.3 | 0.0005 | rest |
| Embodiment 2 | 14.5 | 5.5 | 0.4 | 0.5 | 0.3 | 0.3 | 0.002 | rest |
| Embodiment 3 | 14.5 | 5.5 | 0.4 | 0.5 | 0.3 | 0.3 | 0.01 | rest |
| Embodiment 4 | 14.5 | 5.5 | 0.4 | 0.5 | 0.3 | 0.3 | 0.03 | rest |
| Comparing sample 2 | 14.5 | 5.5 | 0.4 | 0.5 | 0.3 | 0.3 | 0.04 | rest |

Preparing 100 Kg of raw material respectively by weighing in accordance with each row of TABLE 8.

In the melting process: each of the raw materials is put into an aluminum oxide made crucible and an intermediate frequency vacuum induction melting furnace is used to melt the raw material in $10^{-2}$ Pa vacuum below 1500° C.

In the casting process: Ar gas is supplied to the melting furnace so that the Ar pressure would reach 45000 Pa after the process of vacuum melting, then a single roller for quenching method is applied to quench. The quenched alloy is obtained in a cooling rate of $10^{2}$° C./s~$10^{4}$° C./s. The average thickness of the quenched alloy is 0.25 mm. Above 95% of the quenched alloy has a thickness in a range of 0.1~0.7 mm. The quenched alloy is kept in a temperature of 560° C. for 0.5 hours and then cooled to room temperature.

In the hydrogen decrepitation process: at room temperature, the quenched alloy is put into a hydrogen decrepitation furnace. The furnace is then pumped to vacuum and then hydrogen of 99.5% purity is supplied into the container. The hydrogen pressure will reach 0.085 MPa. After two hours of standing, the container is heated and pumped for 2 hours at 540° C., and then the container gets cooled. The cooled coarse powder is then taken out.

In the fine crushing process: jet milling process is used to finely crush the coarse powder in an atmosphere with the content of oxidizing gas below 100 ppm and under a pressure of 0.55 MPa to obtain a fine powder with an average particle size of 3.6 μm. The oxidizing gas comprises oxygen or moisture.

In the compacting process under a magnetic field: a transverse type magnetic field molder is used, the powder with methyl caprylate is compacted to form a cube with sides of 25 mm in an orientation filed of 1.8 T and under a compacting pressure of 0.2 ton/cm$^2$. Then, the once-forming cube is demagnetized in a 0.2 T magnetic field, the green compacts are taken out of the molder to another magnetic field, and the magnetic powder attached to the surface of the green compacts is secondary demagnetized.

The once-forming compact (green compact) is sealed so as not to expose to air. The compact is secondary compacted by a secondary compact machine (isostatic pressing compacting machine) under a pressure of 1.4 ton/cm$^2$.

In the sintering process: the green compact is moved to the sintering furnace to sinter, in a vacuum of $10^{-3}$ Pa and respectively maintained for 2 hours in 200° C. and for 2 hours in 700° C., then sintering for 2 hours in 1050° C. After that, Ar gas is supplied into the sintering furnace so that the Ar pressure reaches 0.1 MPa and then it is cooled to room temperature.

In the thermal treatment process: the sintered magnet is heated for 1 hour in 620° C. in the atmosphere of high purity Ar gas, then cooled to room temperature and taken out.

In magnetic property evaluation process: the sintered magnet is tested by NIM-10000H type nondestructive testing system for BH large rare earth permanent magnet from National Institute of Metrology.

The minimum strength of the saturation magnetic field: when the magnetization voltage increases, the magnetic field strength increases 50% from a value. If the increment of (BH)max or Hcb of the samples is not exceed 1%, the magnetic field value is the minimum strength of the saturation magnetic field.

In the testing process of the average grain diameter of the main phase: the SC sheet (the quenched alloy sheet) is put under the Kerr metallographic microscope magnified 200 times by photography and the roller surface is parallel to the lower edge of the view field. When testing, a straight line of 445 μm at the center position of the view field is drawn and the number of main phase crystals going through the straight line is counted to determine the average grain diameter of the main phase crystal. The testing result is illustrated in FIG. 1.

In the testing process of the Nd rich interval: the SC sheet is corroded by weak $FeCl_2$ solution ($FeCl_2$+HCl+alchol) and is then put under the 3D color scanning laser microscope magnified 1000 times by photography. The roller surface is parallel to the lower edge of the view field. When testing, a straight line of 283 μm at the center position of the view field is drawn and the number of secondary crystals going through the straight line is counted to determine the Nd rich interval. The testing result is illustrated in FIG. 2.

The evaluation of a magnetic property of the embodiments and the comparing samples are shown in TABLE 9.

TABLE 9

| the magnetic property evaluation of the embodiments and the comparing samples | | | | | | |
|---|---|---|---|---|---|---|
| Number | Average grain diameter of main phase crystal (brachyaxis, μm) | Average Nd rich phase interval (μm) | Br (kGs) | Hcj (kOe) | (BH) max (MGOe) | minimum voltage of saturation magnetization (volt) |
| Comparing sample 1 | 16.23 | 2.25 | 12.8 | 13.2 | 38.1 | 2800 |
| Embodiment 1 | 13.01 | 2.10 | 13.9 | 16.1 | 46.4 | 2500 |
| Embodiment 2 | 12.48 | 1.98 | 14.2 | 16.2 | 48.4 | 2500 |
| Embodiment 3 | 11.94 | 1.90 | 14.2 | 16.3 | 48.3 | 2500 |
| Embodiment 4 | 11.45 | 1.86 | 14.0 | 16.3 | 47.0 | 2500 |

TABLE 9-continued the magnetic property evaluation of the embodiments and the comparing samples

| Number | Average grain diameter of main phase crystal (brachyaxis, μm) | Average Nd rich phase interval (μm) | Br (kGs) | Hcj (kOe) | (BH) max (MGOe) | minimum voltage of saturation magnetization (volt) |
|---|---|---|---|---|---|---|
| Comparing sample 2 | 9.90 | 1.82 | 12.9 | 14.3 | 38.3 | 2800 |

In TABLE 9, the minimum voltage of saturation magnetization is the voltage value when the samples are saturated magnetized under the minimum strength of the saturation magnetic field. In the present invention, magnetization is taken under the same magnetization device. Therefore, the magnetization voltage can represent the strength of the magnetic field.

SQ of Embodiments 1~4 reach to more than 99%, while SQ of the comparing samples 1~2 are less than 90%.

As can be seen from TABLE 9, the ionic radius and the electronic structure of W are different from that of the rare earth elements. Fe, B, and almost no W exists in the $R_2Fe_{14}B$ main phase. A small amount of W separates out of the $R_2Fe_{14}B$ main phase during the cooling process of the molten fluids and concentrates to the grain boundary and then separates out in tiny and uniform way. Therefore, appropriate addition of W can be used to control the grain diameter of the main phase crystal of the alloy and thus improve the orientation of the magnet.

Although the present invention has been described with reference to the preferred embodiments thereof for carrying out the patent for invention, it is apparent to those skilled in the art that a variety of modifications and changes may be made without departing from the scope of the patent for invention, which is intended to be defined by the appended claims.

The invention claimed is:

1. A quenched alloy for rare earth magnet, comprising:

an $R_2Fe_{14}B$ main phase, wherein:

R is selected from at least one rare earth element comprising Nd, an average grain diameter of a primary crystallization in a brachyaxis direction is in a range of 10.21-14.88 μm, an average interval of a Nd rich phase is in a range of 1.15-2.77 μm, the quenched alloy has an average thickness in a range of 0.2-0.4 mm, counted in weight percent, more than 95% of the quenched alloy has a thickness in a range of 0.1-0.7 mm, a raw material of the quenched alloy comprises:

R: 13.5 at %-15.5 at %,

B: 5.2 at %-5.8 at %,

Cu: 0.1 at %-0.8 at %,

Al: 0.1 at %-2.0 at %, an atomic percent of W is in a range of 0.0005 at %-0.03 at %, T: 0 at %-2.0 at %, T is selected from at least one of the elements Ti, Zr, V, Mo, Co, Zn, Ga, Nb, Sn, Sb, Hf, Bi, Ni, Si, Cr, Mn, S or P, and remaining components comprise Fe and unavoidable impurity, and the quenched alloy is obtained by strip casting a molten alloy fluid of the raw material and cooling at a cooling rate between $10^{2\circ}$ C./s and $10^{4\circ}$ C./s.

2. The quenched alloy for rare earth magnet according to claim 1, wherein an atomic percent of Cu is in a range of 0.3 at %-0.7 at %.

3. The quenched alloy for rare earth magnet according to claim 1, wherein the quenched alloy is kept in a material container for 0.5-5 hours in a preservation temperature of 500-700° C. after being cooled to 500-750° C.

4. A manufacturing method of rare earth magnet, comprising:

coarsely crushing a quenched alloy for rare earth magnet to generate a powder, wherein:

the quenched alloy comprises an $R_2T_{14}B$ main phase,

R is selected from at least one rare earth element comprising Nd, an average grain diameter of a primary crystallization in a brachyaxis direction is in a range of 10.21-14.88 μm, an average interval of a Nd rich phase is in a range of 1.15-2.77 μm, the quenched alloy has an average thickness in a range of 0.2-0.4 mm, counted in weight percent, more than 95% of the quenched alloy has a thickness in a range of 0.1-0.7 mm, a raw material of the quenched alloy comprises:

R: 13.5 at %-15.5 at %,

B: 5.2 at %-5.8 at %,

Cu: 0.1 at %-0.8 at %,

Al: 0.1 at %-2.0 at %, an atomic percent of W is in a range of 0.0005 at %-0.03 at %, T: 0 at %-2.0 at %, T is selected from at least one of the elements Ti, Zr, V, Mo, Co, Zn, Ga, Nb, Sn, Sb, Hf, Bi, Ni, Si, Cr, Mn, S or P, and remaining components comprise Fe and unavoidable impurity, and the quenched alloy is obtained by strip casting a molten alloy fluid of the raw material and cooling at a cooling rate between $10^{2\circ}$ C./s and $10^{4\circ}$ C./s;

finely crushing the powder to fine powder;

placing the fine powder under a magnetic field for pre-orientating and obtaining green compacts under a magnetic field; and sintering the green compacts in vacuum or in inert gas atmosphere in a temperature of 900° C.-1100° C.

5. The manufacturing method of rare earth magnet according to claim 4, wherein an atomic percent of Cu is in a range of 0.3 at %-0.7 at %.

6. The manufacturing method of rare earth magnet according to claim 4, wherein the quenched alloy is kept in a material container for 0.5-5 hours in a preservation temperature of 500-700° C. after being cooled to 500-750° C.

* * * * *